US006592682B1

(12) United States Patent
Fruchart et al.

(10) Patent No.: US 6,592,682 B1
(45) Date of Patent: Jul. 15, 2003

(54) METHOD FOR PREPARING A MAGNETIC MATERIAL BY FORGING AND MAGNETIC MATERIAL IN POWDER FORM

(75) Inventors: Daniel Fruchart, Echirolles (FR); Rene Perrier De La Bâthie, Saint-Pierre-d'Albigny (FR); Sophie Rivoirard, Lans-en-Vercors (FR); Patricia Rango, Gieres (FR)

(73) Assignee: Santoku Corporation, Hyogo (JP)

( * ) Notice: Subject to any disclaimer, the term of this patent is extended or adjusted under 35 U.S.C. 154(b) by 0 days.

(21) Appl. No.: 09/701,286

(22) PCT Filed: May 26, 1999

(86) PCT No.: PCT/FR99/01234

§ 371 (c)(1),
(2), (4) Date: Jun. 8, 2001

(87) PCT Pub. No.: WO99/62080

PCT Pub. Date: Dec. 2, 1999

(30) Foreign Application Priority Data

May 28, 1998 (FR) ..... 98 06745

(51) Int. Cl.[7] ..... H01F 1/057

(52) U.S. Cl. ..... 148/101; 148/120; 148/301; 148/302; 148/303

(58) Field of Search ..... 148/101, 102, 148/120, 301, 302, 303

(56) References Cited

U.S. PATENT DOCUMENTS

| | | | | |
|---|---|---|---|---|
| 5,352,302 A | * | 10/1994 | Takagi et al. | 148/101 |
| 5,356,489 A | * | 10/1994 | Nozieres et al. | 148/101 |
| 5,516,371 A | | 5/1996 | Kim et al. | |
| 5,580,396 A | * | 12/1996 | Fruchart et al. | 148/101 |
| 6,136,099 A | * | 10/2000 | Akioka et al. | 148/101 |

FOREIGN PATENT DOCUMENTS

| | | | |
|---|---|---|---|
| JP | 1-175207 | * | 7/1989 |
| JP | 4-91403 | * | 3/1992 |
| JP | 4-91404 | * | 3/1992 |
| JP | 4-134806 | * | 5/1992 |
| JP | 5-135924 | * | 6/1993 |
| JP | 5175027 | | 7/1993 |

OTHER PUBLICATIONS

Hatch, G. et al, "Upset Forging of an AS Cast Pr–Fe–B–Cu Alloy in Air", Journal of Magnetism and Magnetic Materials, vol. 157/158, pp. 69–70(May 1,1996).

Yang, J. et al, "A New Method for the Preparation of Anisotropic Nd–Fe–B–Based Magnets", IEEE Transactions of Magnetics, vol. 33, No. 5, part 2, pp. 3820–3822, (Sep. 1997).

* cited by examiner

*Primary Examiner*—John Sheehan
(74) *Attorney, Agent, or Firm*—Stevens, Davis, Miller & Mosher, LLP

(57) ABSTRACT

The invention concerns a method for preparing a magnetic material by forging, characterised in that, in a first embodiment, it comprises the following steps; placing in a sheath an alloy based on at least one rare earth, at least one transition metal and at least one other element selected among boron and carbon; bringing the whole alloy to a temperature not less than 500° C.; forging the whole at a deformation speed of the material not less than 8 $s^{-1}$. After forging, it is possible to subject the resulting product to at least one annealing and hydridation then dehydridation, in another embodiment, it consists in starting with an alloy based on at least one rare earth and one transition metal and proceeding as in the first embodiment. After forging and, optionally, annealing, hydridation and dehydridation treatments, the resulting material is subjected to nitriding. The invention also concerns a magnetic material in power form, characterised in that has a coercivity not less than 9 kOe and retentivity not less than 9 kG.

29 Claims, No Drawings

METHOD FOR PREPARING A MAGNETIC MATERIAL BY FORGING AND MAGNETIC MATERIAL IN POWDER FORM

The present invention relates to the preparation of a magnetic material by forging and to a magnetic material in powder form.

Permanent magnets based on iron, boron and rare earths are well known. Their importance in the electrical or electronics industry is growing.

There are two main types of process for preparing these magnets. The first makes use of powder metallurgy in order to prepare dense or sintered magnets.

Another process consists in melting an alloy and then quenching it on a wheel, in annealing it and in hot pressing or encapsulating the powder thus obtained in a resin or a polymer. This process makes it possible to obtain bonded magnets. The powder and the magnet obtained by implementing this process are usually isotropic. In order to obtain an isotropic powder or magnet, it is currently necessary to use expensive processes which are inefficient or which give inadequate results.

There is therefore a need for a process for producing anisotropic products which is simpler to implement, is possibly more economical or has an improved efficiency and which leads to products with satisfactory or even improved properties.

The subject of the invention is the development of such a process.

To this end, the process of the invention for the preparation of a magnetic material is characterized in that it comprises the following steps:

- an alloy based on at least one rare earth, on at least one transition metal and on at least one other element chosen from boron and carbon is placed in a sheath;
- the assembly is heated to a temperature of at least 500° C.;
- the assembly is subjected to a forging operation with a strain rate of the material of at least 8 $s^{-1}$.

According to a second version, the process of the invention is characterized in that it comprises the following steps:

- an alloy based on at least one rare earth and on at least one transition metal is placed in a sheath;
- the assembly is heated to a temperature of at least 500° C.;
- the assembly it subjected to a forging operation with a strain rate of the material of at least 8 $s^{-1}$;
- the product after forging is subjected to a nitriding treatment.

The invention also relates to a magnetic material in powder form which is characterized in that it has a coercivity of at least 9 kOe and a remanence of at least 9 kG.

Further characteristics, details and advantages of the invention will become even more apparent on reading the description which follows, together with the concrete but non-limiting examples intended to illustrate it.

The present invention applies, according to its first version, to the preparation of magnetic materials based on at least one rare earth, on at least one transition metal and on at least one other element chosen from boron and carbon. The process of the invention therefore starts in this case with alloys having the composition required for obtaining the desired material. This composition may vary both in regard to the nature of its constituents and the respective proportions of them.

The invention involves alloys which comprise at least one rare earth and at least one transition metal and which also contain at least one other element chosen from boron and carbon. Such alloys are well known.

Throughout the description, the term "rare earth" should be understood to mean one of the elements of the group formed by yttrium and the elements of the Periodic Table having an atomic number of between 57 and 71 inclusive. The Periodic Table of the Elements to which reference is made throughout the description is the one published in the Supplément au Bulletin de la Société Chimique de France [*Supplement to the Bulletin of the Chemical Society of France*] No. 1 (January 1966).

The rare earth of the alloy may be neodymium or else praseodymium. Alloys based on several rare earths may be used. Mention may more particularly be made of alloys based on neodymium and praseodymium. In the case of an alloy of several rare earths, neodymium and/or praseodymium may be the major component(s).

The term "transition elements" should be understood to mean the elements of Columns IIIa to VIIa, VIII, Ib and IIb. In the present case, these transition elements may be more particularly those chosen from the group comprising iron, cobalt, copper, niobium, vanadium, molybdenum and nickel, it being possible for these elements to be taken alone or in combination. According to a preferred version, the transition element is iron or else iron in combination with at least one element of the aforementioned group, iron being the major component.

Apart from the aforementioned elements, the alloy may comprise additives such as gallium, aluminium, silicon, tin, bismuth, germanium, zirconium or titanium, taken alone or in combination.

The respective proportions of rare earth, of transition metal and of the other aforementioned element may vary widely. Thus, the rare-earth content may be at least 1% (the percentages given here are atomic percentages) and it may vary between approximately 1% and 30%, more particularly between approximately 1% and 20%. The content of the third element, especially boron, may be at least 0.5% and it may vary between approximately 0.5 and 30%, more particularly between approximately 2 and 10%. In the case of the additives, their content may be at least 0.05% and it may vary from approximately 0.05 to 5%.

By way of examples of alloys, mention may most particularly be made of neodymium/iron/boron alloys, especially those which also comprise copper. Mention may also be made, as alloys which can be used more particularly in the context of the present invention, of those which have a phase satisfying the formula $RE_2Fe_{14}B$, RE denoting at least one rare earth, most particularly neodymium.

The invention also applies, according to its second version, to the preparation of magnetic materials based on at least one rare earth, on at least one transition metal and on nitrogen. The process used in this case starts with alloys having the composition, in terms of rare earth and of transition metal, required to obtain the desired material. Everything that was stated above in regard to the rare earth, the transition element and the optional additives also applies in this ease. However, mention may more particularly be made of alloys based on samarium and iron, from which alloys magnetic materials based on samarium, iron and nitrogen will be obtained.

It will be noted that the alloys used as starting products do not have the properties of magnets, or do so very slightly. In particular, they have a very small or zero coercivity and exhibit very little or no anisotropy. The alloys that are used generally consist of mostly large, single-crystal grains with a size of at least approximately 10 $\mu$m. Here, and for the entire description, sizes are measured by SEM. The alloys may be in bulk form or in powder form. The alloys are generally heterogenous with regard to the grain size, to the nature of the phases and, in the case of a powder, to the particle size.

Prior to the treatment of the invention, the alloy may be annealed at a temperature of at least 500° C. in an inert atmosphere.

The alloy as described above is placed in a sheath. Advantageously, a cylindrical sheath is used. The height of this sheath is preferably at least equal to the height of the alloy to be treated. Its wall thickness is chosen in such a way that it does not burst during forging, but this thickness must remain relatively small. The material of which the sheath is composed must be as plastic as possible at the temperature at which forging takes place. Generally, a metal sheath is used. Preferably, the sheath is made of steel.

The alloy may be introduced into the sheath by the molten alloy being cast into it, or by any mechanical means starting with an ingot or with powder.

The alloy/sheath assembly is then heated to a temperature of at least 500° C. The maximum temperature not to be exceeded is that above which there is a risk of significant melting of the grains or particles of the alloy occurring. This temperature is more specifically between 600° C. and 1100° C. more particularly between 800° C. and 1000° C. The alloy is heated to the indicated temperature in an inert atmosphere, for example in argon.

However, it is possible to carry out the process in a sealed casing. This means that, once the alloy has been placed in the sheath, the top and bottom of the assembly formed by the sheath and the alloy are sealed by means of a cover made of a material which may be of the same nature as that of the sheath, the cover being welded to the sheath. The alloy is thus isolated from the outside and it may be heated to the required temperature without it being necessary to work in an inert atmosphere.

The next step of the process of the invention consists in subjecting the alloy in the sheath to a forging operation. The forging consists of a percussion: the alloy/sheath assembly is given one or more blows by a forge hammer. Forging takes place on the alloy/sheath assembly at the temperature indicated above. When the sheath is not sealed, the alloy/sheath assembly is placed in a sealed chamber surrounding the anvil of the forge. This chamber is connected to a source of inert gas and comprises an opening through which the forge hammer can pass via a seal.

Generally, the number of hammer blows is between 1 and 10.

The mechanical power of the hammer blow must be such that the constituent grains of the alloy break. It must also be such that some of this power serves to heat the material, allowing several successive forging treatments, without heating up the alloy from the outside. Thus, this power may, for example, be at least about 1 kilowatt per gramme of material (kW/g), more particularly at least 5 kW/g. Such a power corresponds to a strain rate of the material of at least 8 $s^{-1}$, especially at least 10 $s^{-1}$ more particularly at least 50 $s^{-1}$ and even more particularly at least 100 $s^{-1}$. The strain rate of the material is defined by the expression (dh/h)/dt, dh/h denoting the (initial height−final height)/initial height ratio, the height being that of the alloy/sheath assembly, dt denoting the compression time, which is equal to dh/(v/2), v being the speed of the hammer at the moment of impact and v/2 being regarded, to a first approximation, as the average speed during compression, which average speed may in fact be defined as the (initial speed−final speed)/2 ratio, i.e. (v-0)/2.

Such a power corresponds to devices in which the hammer speed is at least 0.3 m/s, especially 0.5 m/s, more particularly at least 1 m/s and even more particularly at least 4 m/s.

Forging may be carried out with a reduction ratio of at least 2. The reduction ratio is defined by the initial height (before forging)/final height (after forging) ratio of the alloy/sheath assembly. This ratio may be more particularly at least 5.

According to a preferred embodiment of the invention, forging is carried out in a direction perpendicular to an easy growth axis of the crystallites of the alloy. In the case of the $Nd_2Fe_{14}B$ phase, this easy growth axis is the a or b axis of the tetragonal unit cell. In this case, forging allows the c axes to move from an equatorial distribution to an approximately unidirectional distribution.

After forging, the product obtained is in the form of a flat cylinder, or possibly in the form of a capsule when a sealed casing has been used, as described above, the internal part of which contains the starting metal alloy and the peripheral or external part of which comprises the starting sheath. The alloy now consists of single-crystal grains, the average size of which is at most 30 $\mu$m, more particularly at most 10 $\mu$m. The alloy has a coercivity and is anisotropic. The magnetization axes are aligned parallel to the forging direction.

According to the second version of the invention, and for the purpose of obtaining a magnetic material based on at least one rare earth, on at least one transition metal and on nitrogen, the product after forging is subjected to a nitriding treatment. The nitriding treatment is carried out in a known manner. The nitrogen content of the material obtained may be of the same order as that given above in the case of boron, more particularly it may be between 2 and 15%.

The process of the invention may furthermore comprise, after the forging step, other, complementary steps involving treatments which will be described below. In the case of the preparation of a magnetic material based on at least one rare earth, on at least one transition metal and on nitrogen, the preparation including a nitriding step, the complementary treatments are preferably carried out before this nitriding step.

The various complementary treatments which will now be described may be carried out in any order.

By way of complementary treatment, it is thus possible for the product after forging to be subjected to at least one annealing treatment in order to improve its magnetic properties.

Various types of annealing treatment may be envisaged. A first type is carried out at a temperature which may be between 700° C. and 1100° C. The treatment is preferably carried out in an inert atmosphere, for example in argon. The duration of the treatment may be between a few minutes and a few hours.

Another type of annealing treatment may be carried out at a temperature of between 400° C. and 700° C., also preferably in an inert atmosphere of the argon type. The duration of the treatment may be between a few minutes and a few hours.

Of course, it is quite possible to carry out one or more annealing treatments of the same type or of a different type. For example, a treatment of the first type mentioned above may be carried out followed by a second treatment of the second type.

As another complementary treatment, it is also possible to provide a hydrogen cracking process for the purpose of obtaining a powder having magnetic properties similar to those of the bulk product. Thus, the material obtained after forging, and optionally after at least one annealing treatment, may be subjected to a hydriding treatment, so as to obtain a hydride of the alloy, and then a dehydriding treatment.

Hydriding and dehydriding treatments are known. The material may be dehydrided in a hydrogen atmosphere (for example, at at least 0.1 MPa) at room temperature or else by thermally activating the material in an atmosphere containing hydrogen. For example, the material may be thermally activated up to a temperature of lens than 500° C., preferably less than 300° C. The hydrided material may be dehydrided by being heated at a temperature of at least 500° C. in vacuo. The temperature and the heating time are chosen so that the material is completely dehydrided. Optionally, the dehydriding treatment may be followed by an annealing treatment of the first and/or second type mentioned above.

After this treatment, a material in powder form having useful magnetic properties is obtained. Thus, this material has a coercivity of at least 9 kOe, more particularly at least 9.5 kOe and even more particularly at least 10 kOe, in combination with a remanence of at least 9 kG, more particularly of at least 9.5 kG and even more particularly of at least 10 kG. The material may have each of the coercivity values given above in combination with each of the remanence values, also given above, for example a coercivity of 9 kOe in combination with a remanence of 9.5 kG. The material has a crystalline texture, making it magnetically anisotropic. The constituent particles of the powder themselves consist not of just one single-crystal grain but of several single-crystal grains having an average size of at least 0.1 $\mu$m. Thus, for example, the particles may have a size of a few tens of microns, especially between approximately 10 $\mu$m and approximately 200 $\mu$m, more particularly between approximately 10 $\mu$m and approximately 100 $\mu$m, and may consist of about ten grains each being a few microns in size.

With regard to its composition, the material consists of the constituent elements which were given above for the alloy and that which was described in that case also applies in this case, the material being based, in particular, on at least one rare earth, on at least one transition metal and on at least one other element chosen from boron, carbon and nitrogen.

Examples will now be given.

The alloy used satisfies the formula $Nd_{15.3}Fe_{76.8}B_{4.9}Cu_{1.5}Al_{1.5}$ in the case of Examples 1 and 2, the formula $Nd_{15.5}Fe_{78}B_5Cu_{1.5}$ in the case of Example 3 and the formula $Nd_{15.3}Fe_{76.9}B_{4.9}Cu_{1.5}Nb_{0.5}Al_{0.9}$ in the case of Example 4.

Tests are carried out on a cylindrical steel sheath. In certain cases, the alloy is subjected to two hammer blows (first forging and second forging).

Table 1 gives the characteristics of the starting material, Tables 2 and 3 give the forging conditions and Table 4 gives the magnetic properties of the bulk materials obtained.

TABLE 1

| Example | Mass of the sheath and alloy (g) | Diameter (mm) | Height (mm) | Thickness of the sheath (mm) |
|---|---|---|---|---|
| 1 | 20.18 | 12 | 25 | 2 |
| 2 | 15.76 | 12 | 20 | 1 |
| 3 | 20.31 | 12 | 25 | 1 |
| 4 | 19.98 | 12 | 24.5 | 1 |

TABLE 2

| Example | $T_1$ (° C) | $T_2$ (° C) | E ($s^{-1}$) | $Tr_1$ | $Tr_2$ |
|---|---|---|---|---|---|
| 1 | 980 | 890 | 95.0 | 4.39 | 6.25 |
| 2 | 1060 | — | 112.5 | 5.90 | — |

TABLE 2-continued

| Example | $T_1$ (° C) | $T_2$ (° C) | E ($s^{-1}$) | $Tr_1$ | $Tr_2$ |
|---|---|---|---|---|---|
| 3 | 995 | — | 95.6 | 6.00 | — |
| 4 | 1000 | — | 92 | 6 | — |

$T_1$: temperature during the first forging
$T_2$: temperature during the second forging
E: strain rate during the first forging
$Tr_1$: reduction ratio after the first forging
$Tr_2$: total reduction ratio after the second forging

TABLE 3

| Example | $V_1$ (m/s) | $V_2$ (m/s) | $P_1$ (kW/g) | $P_2$ (kW/g) |
|---|---|---|---|---|
| 1 | 4.75 | 4 | 10.3 | 70 |
| 2 | 4.54 | — | 13.9 | — |
| 3 | 4.78 | — | 9.8 | — |
| 4 | 4.48 | — | 8.3 | — |

$V_2$: hammer speed during the first forging
$V_2$: hammer speed during the second forging
$P_1$: mechanical power of the first hammer blow
$P_2$: mechanical power of the second hammer blow

TABLE 4

| | Coercivity Hc | | Remanence Br | | Energy product | |
|---|---|---|---|---|---|---|
| Example | kOe | kA/m | kG | T | MGOe | $kJ/m^3$ |
| 1 | 9.5 | 756 | 10 | 1 | 17.5 | 139 |
| 2 | 10.0 | 796 | 10 | 1 | 16 | 127 |
| 3 | 9.5 | 756 | 10 | 1 | 17.5 | 139 |
| 4 | 10.1 | 804 | 9.9 | 0.99 | 21 | 167 |

The remanence values given in Table 4 show that the products are anisotropic.

What is claimed is:

1. Process for the preparation of a magnetic material, comprising the following steps:

placing an alloy based on at least one rare earth, at least one transition metal and at least one other element selected from the group consisting of boron and carbon in a sheath to form an assembly;

heating the assembly to a temperature of at least 500° C.; and subjecting the assembly to a forging operation with a strain rate of the material of at least 8 $s^{-1}$, wherein the forging is carried out in a direction perpendicular to an easy growth axis of the crystallites of the alloy.

2. Process for the preparation of a magnetic material based on at least one rare earth, at least one transition metal, and nitrogen, comprising the following steps:

placing an alloy based on at least one rare earth and at least one transition metal in a steel sheath to form an assembly;

heating the assembly to a temperature of at least 500° C.;

subjecting the assembly to a forging operation with a strain rate of the material of at least 8 $s^{-1}$; and subjecting the alloy after forging to a nitriding treatment.

3. Process according to claim 1, wherein the forging is carried out with a strain rate of the material of at least 10 $s^{-1}$.

4. Process according to claim 1, wherein the forging is carried out with a reduction ratio of at least 2.

5. Process according to claim 1, wherein the rare earth comprises neodymium.

6. Process according to claim 1, wherein the alloy is based on iron.

7. Process according to claim 1, wherein the at least one other element is boron.

8. Process for the preparation of a magnetic material, comprising the following steps:

placing an alloy based on at least one rare earth, at least one transition metal and at least one other element selected from the group consisting of boron and carbon in a sheath to form an assembly;

heating the assembly to a temperature of at least 500° C.; and subjecting the assembly to a forging operation with a strain rate of the material of at least 8 $s^{-1}$, wherein the alloy also comprises copper.

9. Process according to claim 1, wherein the sheath is made of steel.

10. Process according to claim 8, wherein the sheath is made of steel.

11. Process for the preparation of a magnetic material, comprising the following steps:

placing an alloy based on at least one rare earth, at least one transition metal and at least one other element selected from the group consisting of boron and carbon in a sheath to form an assembly;

heating the assembly to a temperature of at least 500° C.; and subjecting the assembly to a forging operation with a strain rate of the material of at least 8 $s^{-1}$, wherein the material obtained after forging is subjected to at least one annealing treatment.

12. Process for the preparation of a magnetic material, comprising the following steps:

placing an alloy based on at least one rare earth, at least one transition metal and at least one other element selected from the group consisting of boron and carbon in a sheath to form an assembly;

heating the assembly to a temperature of at least 500° C.; and subjecting the assembly to a forging operation with a strain rate of the material of at least 8 $s^{-1}$, wherein the material obtained after forging, and, optionally, after at least one annealing treatment, is subjected to a hydriding treatment and then to a dehydriding treatment, so as to change the material into powder form.

13. Magnetic material in powder form, based on at least one rare earth, at least one transition metal and at least one other element selected from the group consisting of boron and carbon obtained by the process according to claim 12, having a coercivity of at least 9 kOe and a remanence of at least 9 kG.

14. Material according to claim 13, in the form of a powder consisting of 10 to 200 $\mu$m particles.

15. Material according to claim 13, in the form of a powder, the particles of which comprise single-grain crystals having an average size of at least 0.1 $\mu$m.

16. Material according to claim 13, which is magnetically anisotropic.

17. Process according to claim 1, herein the forging is carried out with a strain rate of the material of at least 50 $s^{-1}$.

18. Process according to claim 1, wherein the forging is carried out with a strain rate of the material of at least 100 $s^{-1}$.

19. Process according to claim 2, wherein the forging is carried out with a strain rate of the material of at least 10 $s^{-1}$.

20. Process according to claim 2, wherein the forging is carried out with a strain rate of the material of at least 50 $s^{-1}$.

21. Process according to claim 2, wherein the forging is carried out with a strain rate of the material of at least 100 $s^{-1}$.

22. Process according to claim 2, wherein the forging is carried out with a reduction ratio of at least 2.

23. Process according to claim 2, wherein the forging is carried out in a direction perpendicular to an easy growth axis of the crystallites of the alloy.

24. Process according to claim 2, wherein the rare earth comprises samarium.

25. Process according to claim 2, wherein the alloy is based on iron.

26. Process according to claim 2, wherein the material obtained after forging, and before the nitriding treatment, is subjected to at least one annealing treatment.

27. Process according to claim 2, wherein the material obtained after forging, and, optionally, after at least one annealing treatment, is subjected to a hydriding treatment and then to a dehydriding treatment, so as to change the material into powder form, and followed by a nitriding treatment.

28. Process for the preparation of a magnetic material, comprising the following steps:

placing an alloy based on at least one rare earth, at least one transition metal and at least one other element selected from the group consisting of boron and carbon in a sheath to form an assembly;

heating the assembly to a temperature of at least 500° C.; and subjecting the assembly to a forging operation with a strain rate of the material of at least 8 $s^{-1}$, wherein the alloy prior to said forging comprises mostly large, single crystal grains with a size of at least approximately 10 $\mu$m.

29. Material according to claim 13, in the form of a powder, the particles of which comprise single-grain crystals having an average size of at least 0.1 $\mu$m and the particles comprise particles having a size between 10 and 200 $\mu$m.

* * * * *